US006318967B1

(12) United States Patent
Wirz et al.

(10) Patent No.: US 6,318,967 B1
(45) Date of Patent: Nov. 20, 2001

(54) GAS COMPRESSION KIT AND METHOD WITH INTERCHANGEABLE COMPRESSION CYLINDERS

(75) Inventors: William C. Wirz, Corning; Robert A. Bennitt, Painted Post, both of NY (US)

(73) Assignee: Dresser-Rand Company, The Woodlands, TX (US)

( * ) Notice: Subject to any disclaimer, the term of this patent is extended or adjusted under 35 U.S.C. 154(b) by 0 days.

(21) Appl. No.: 09/516,066

(22) Filed: Mar. 1, 2000

(51) Int. Cl.[7] ..... F04B 19/00; F04B 39/10
(52) U.S. Cl. ..... 417/53; 417/238; 417/536
(58) Field of Search ..... 417/238, 254, 417/267, 535, 536, 53

(56) References Cited

U.S. PATENT DOCUMENTS

| | | | | |
|---|---|---|---|---|
| 171,805 | * | 1/1876 | Hill, Jr. | 417/535 |
| 1,301,209 | * | 4/1919 | Worden | 417/258 |
| 1,697,734 | * | 1/1929 | Quandt, Jr. | 417/536 |
| 3,207,083 | * | 9/1965 | Lohry et al. | 417/536 |
| 5,011,383 | | 4/1991 | Bennitt . | |
| 5,015,158 | | 5/1991 | Bennitt . | |
| 5,141,413 | | 8/1992 | Bennitt . | |
| 5,209,647 | | 5/1993 | Bennitt . | |
| 5,236,008 | | 8/1993 | Bennitt . | |
| 5,378,116 | | 1/1995 | Bennitt et al. . | |
| 5,378,117 | | 1/1995 | Bennitt . | |
| 5,564,906 | | 10/1996 | Bennitt et al. . | |
| 5,564,914 | * | 10/1996 | Kobayashi et al. | 417/423.7 |
| 5,567,133 | * | 10/1996 | Kobayashi et al. | 417/423.7 |
| 5,622,486 | * | 4/1997 | McDuffle et al. | 417/536 |
| 5,727,930 | | 3/1998 | Bennitt et al. . | |

* cited by examiner

*Primary Examiner*—Charles G. Freay
(74) *Attorney, Agent, or Firm*—Haynes and Boone, LLP

(57) ABSTRACT

A gas compression apparatus and method according to which a compression cylinder is connected between two heads, and gas is introduced into at least one header and into the cylinder. A piston is reciprocated in the cylinder with a stroke corresponding to the length of the cylinder to compress the gas after which the compressed gas is discharged from the cylinder. If the cylinder bore becomes damaged or wears out, or if it is desired to change the stroke length of the piston, the cylinder can easily be replaced by disconnecting it from the heads and installing another cylinder between the heads.

29 Claims, 4 Drawing Sheets

20a
20
20b
20c
10
20d
20e
12
14
16
30
40
44
16
16
28a
28b
24d
24e
24b
24c
24
24a 20a
20b
20c
20
20d
20e
12
14
16
12a
14a
22a
22b
42
30
42
40
44
34
38
36
42
42
26a
26b
12b
14b
16
28a
28b
24d
24e
24
24b
24c
24a 50
52
50a
52a
12
14
16
40
44
16
16
28a
28b
54a
54b
54
56

GAS COMPRESSION KIT AND METHOD WITH INTERCHANGEABLE COMPRESSION CYLINDERS

BACKGROUND

This invention relates to a gas compression apparatus and method and, more particularly, to such an apparatus and method providing interchangeable compression cylinder sections allowing for changes in stroke or facilitating cylinder replacement.

Gas compressors having a piston that reciprocates in a compression cylinder mounted between two end heads are well known. Many designs of this type are utilize a single casting that includes the cylinder and the end heads which causes several problems.

For example when the cylinder bore is damaged or wears out, the entire casting must be removed from operation and hauled to a machine shop or the like. Also, if it is desired to use another cylinder having a different bore length to attain a different piston stroke length the entire casting must be replaced.

Therefore what is needed is a gas compressor system and method according to which the cylinder can be easily and quickly replaced with a minimum of down time.

SUMMARY

According to an embodiment of the present invention a compression cylinder is connected between two heads, and gas is introduced into at least one head and into the cylinder. A piston is reciprocated in the cylinder with a stroke corresponding to the length of the cylinder to compress the gas after which the compressed gas is discharged from the cylinder. If the cylinder bore becomes damaged or wears out, or if it is desired to change the stroke length of the piston, the cylinder can easily be replaced by disconnecting it from the heads and installing another cylinder between the heads.

DETAILED DESCRIPTION

Figure 1:
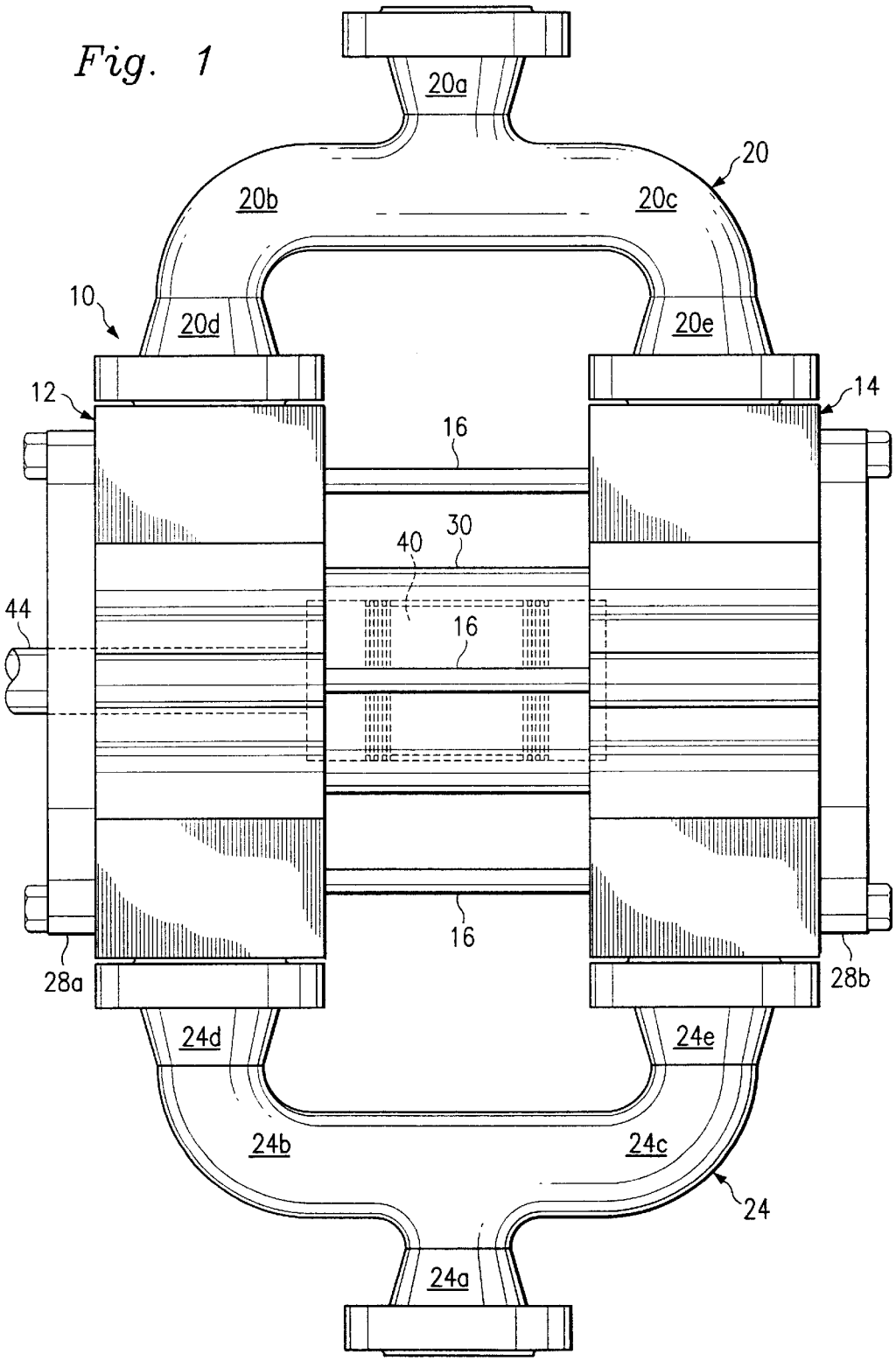
FIG. 1 is a front elevational view of a gas compression apparatus according to an embodiment of the present invention.
Figure 2:
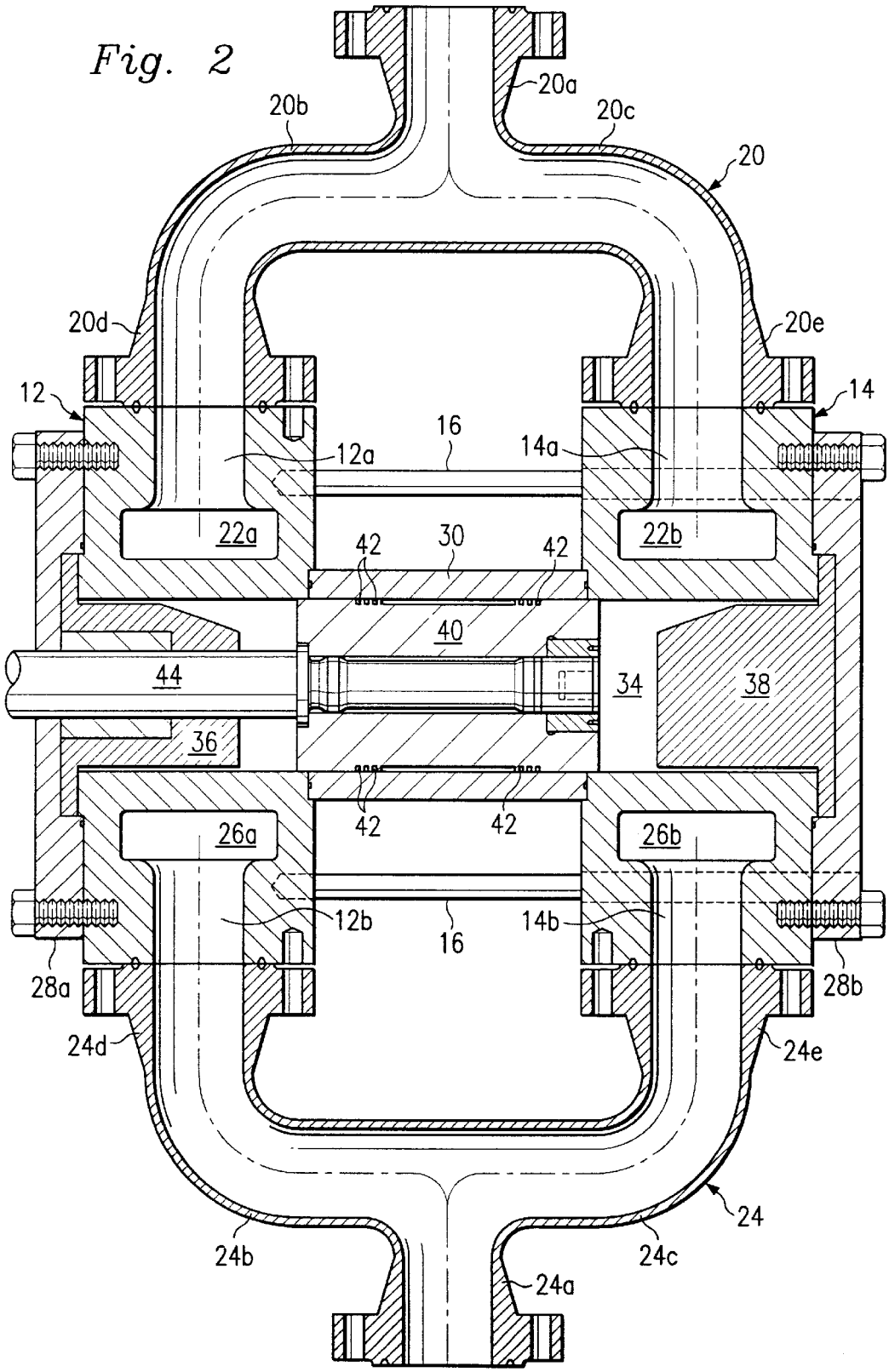
FIG. 2 is a cross-sectional view of the apparatus of FIG. 1.
Figure 3:
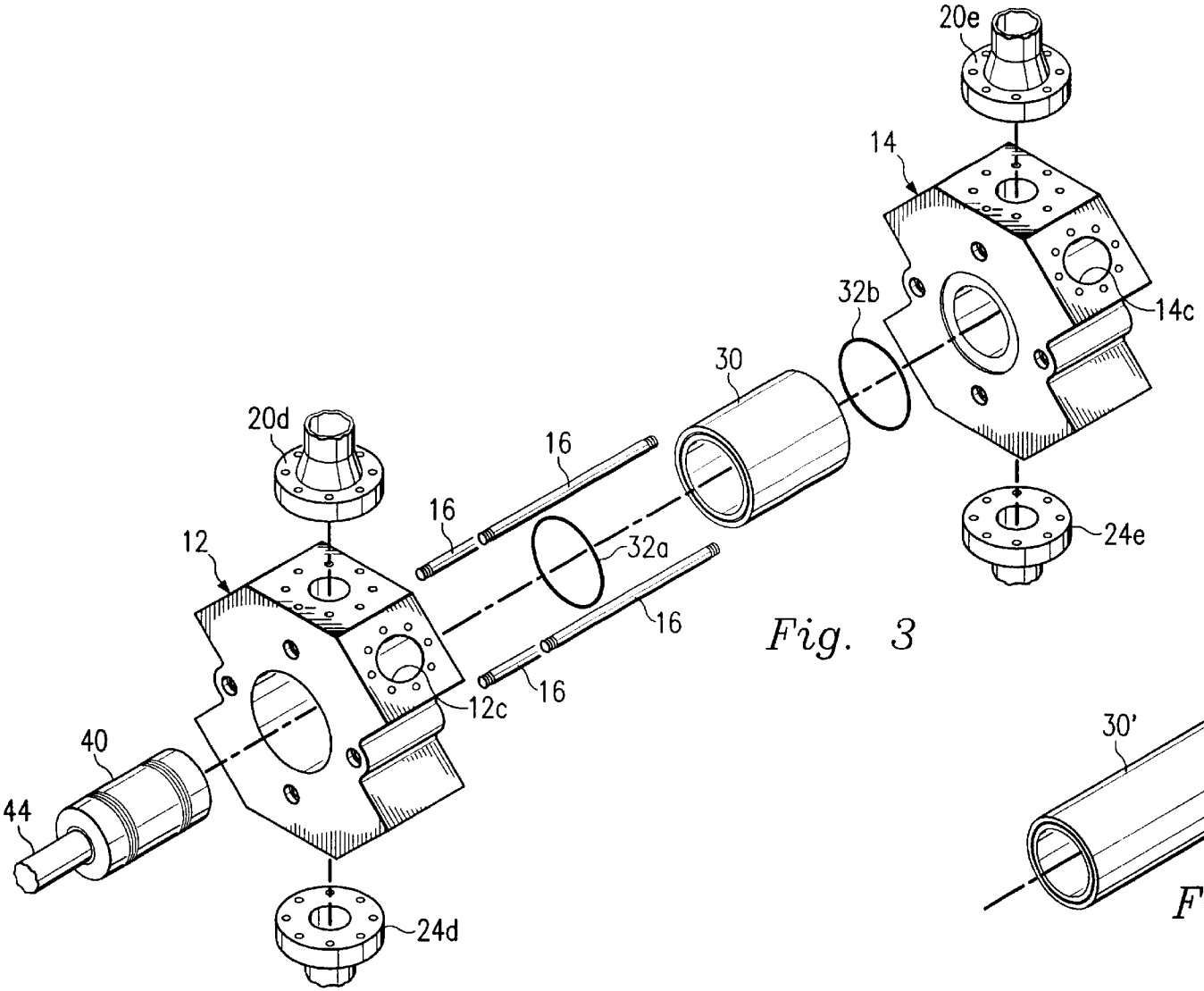
FIG. 3 is an exploded isometric view, on a reduced scale, of the apparatus of FIGS. 1 and 2.

With reference to FIGS. 1–3, a gas compressor assembly according to an embodiment of the present invention, is referred to, in general, by the reference numeral 10. The assembly 10 comprises a pair of spaced end heads 12 and 14 connected together by tie rods 16 of suitable size and number to resist the gas loads.

An inlet manifold 20 is provided that has an inlet head 20*a* adapted to be bolted to a source of gas, and two branch conduits 20*b* and 20*c* connecting the inlet head to two outlet heads 20*d* and 20*e*, respectively. The heads 20*d* and 20*e* are bolted to the upper surfaces of the end heads 12 and 14, respectively, as viewed in FIGS. 1 and 2, and register with inlet openings formed in the upper surfaces. The latter inlet openings flange with two bores 12*a* and 14*a* (FIG. 2) formed in the heads 12 and 14, respectively, which, in turn connect with two chambers 22*a* and 22*b*, respectively, also formed in the heads, for reasons to be described.

An outlet manifold 24 has an outlet head 24*a* adapted to be bolted to a receptacle, or vessel, for receiving the compressed gas, and two branch conduits 24*b* and 24*c* connecting the outlet head to two inlet heads 24*d* and 24*e*, respectively. The heads 24*d* and 24*e* are bolted to the respective lower surfaces of the heads 12 and 14 and register with outlet openings formed in the end heads. The latter outlet openings register with two bores 12*b* and 14*b* formed in the heads 12 and 14, respectively, which, in turn, connect with two chambers 26*a* and 26*b*, respectively.

A pair of covers 28*a* and 28*b* are partially shown in FIG. 2 and extend over the outer surfaces of the heads 12 and 14, respectively, and are connected thereto in any known manner.

A cylinder 30 extends between the heads 12 and 14 with its respective end portions being registered in counterbores respectively formed in the corresponding side surfaces of the heads. Two gaskets 32*a* and 32*b* extend between the ends of the cylinder and the corresponding bottoms of the counterbores in the heads 12 and 14, respectively. The bore of the cylinder 30 is aligned with through bores formed through the heads 12 and 14 to form a continuous bore, referred to, in general, by the reference numeral 34. Although not shown in the drawings, it is understood that the chambers 22*a*, 22*b*, 24*a*, and 24*b* communicate with the bore 34 through openings formed in the heads 12 and 14.

Two heads 36 and 38 are mounted in the heads 12 and 14 to close off the ends of the bore 34. The outer end portions of the heads 36 and 38 extend out from the respective surfaces of the heads 12 and 14, and through corresponding openings formed in the covers 26 and 28.

A piston 40 is mounted for reciprocating movement in the bore 34 and has a plurality of circumferential grooves formed in its outer surface for receiving a corresponding number of seal rings 42. A piston rod 44 is disposed in the bore with one end portion extending into a bore formed in the piston and is connected thereto for driving the piston. The piston rod 44 extends through an opening in the head 36 and its other end portion extends out from the header 12 and the cover 26 (FIG. 1). It is understood that a prime mover, in the form of a motor, engine, or the like, is connected to the latter end portion of the piston rod 44 for reciprocating the piston 40 in the bore 34.

As shown in FIG. 3, two bores 12*c* and 14*c* are formed in the upper portions of the heads 12 and 14, respectively, are angularly offset with respect to the bores 12*a* and 14*a*, respectively, and communicate with the chambers 22*a* and 22*b* (FIG. 2). Two valves (not shown) are mounted in the bores 12*c* and 14*c* and function in a conventional manner to control the ingress of gas into and through the bores 12*a* and 14*a*, through the chambers 22*a* and 22*b*, respectively, and into the bore 34 for compression by the piston 40 in a manner to be described. Similarly, two bores (not shown) are respectively formed in the lower portions of the heads 12 and 14 that are angularly offset with respect to the bores 12*b* and 14*b*, respectively and communicate with the chambers 26*a* and 26*b*. These latter bores also receive valves that control the egress of the compressed gas from the bore 34, through the chambers 26*a* and 26*b* and the bores 12*b* and 14*b* for discharge through the manifold 24, also in a manner to be described.

In operation, as the piston 40 reciprocates in the bore 34 in a direction from left-to-right as viewed in FIG. 2, gas from the manifold 20 is drawn into the bore 12*a* in the header 12 and into the chamber 22*a* under the vacuum caused by this movement. The gas then passes into the portion of the bore 34 extending to the left of the piston 40 under control of the valve in the bore 12*c*. This movement also compresses the gas in the portion of the bore 34 extending to the right of the piston 40 and forces it from the latter bore portion, through the chamber 26*b* and the bore 14*b*, and into and through the manifold 24 for passage to a storage vessel, or the like.

Similarly, as the piston 40 reciprocates in the bore 34 in a direction from right-to-left as viewed in FIG. 2, gas from the manifold 20 is drawn into the bore 14*a* in the header 14 and into the chamber 22*b* under the vacuum caused by this movement. The gas then passes into the portion of the bore 34 extending to the right of the piston 40 under control of the valve in the bore 12*c*. This movement also compresses the gas in the portion of the bore 34 extending to the left of the piston 40 and forces it from the latter bore portion, through the chamber 26*a* and the bore 12*b*, and into and through the manifold 24 for passage to a storage vessel, or the like.

Figure 4:
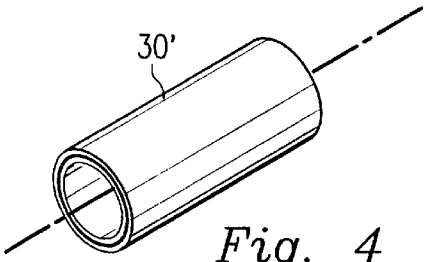
FIG. 4 is an isometric view depicting a alternate compression cylinder that can be used in the apparatus of FIGS. 1–3.

The cylinder 30 can also easily be replaced with one that has a different length in order to obtain a different stroke length of the piston 40. As shown in FIG. 4, a cylinder 30' is provided that has the same diameter as the cylinder 30 but is of a longer length. The cylinder 30' can easily and quickly be substituted for the cylinder 30 by removing the manifolds 20 and 24 from the heads 12 and 14, and removing the cylinder 30 from the heads. The cylinder 30' is then connected to the heads 12 and 14 in the manner discussed above, and the manifolds 20 and 24 are connected back to the heads 12 and 14. In the latter contest the lengths of the manifolds 20 and 24 will have to be increased to accommodate the increased-length cylinder 30'.

Of course, in the event the cylinder 30 becomes damaged or wears out, it can easily be replaced with a new cylinder in the same manner as discussed above.

Figure 5:
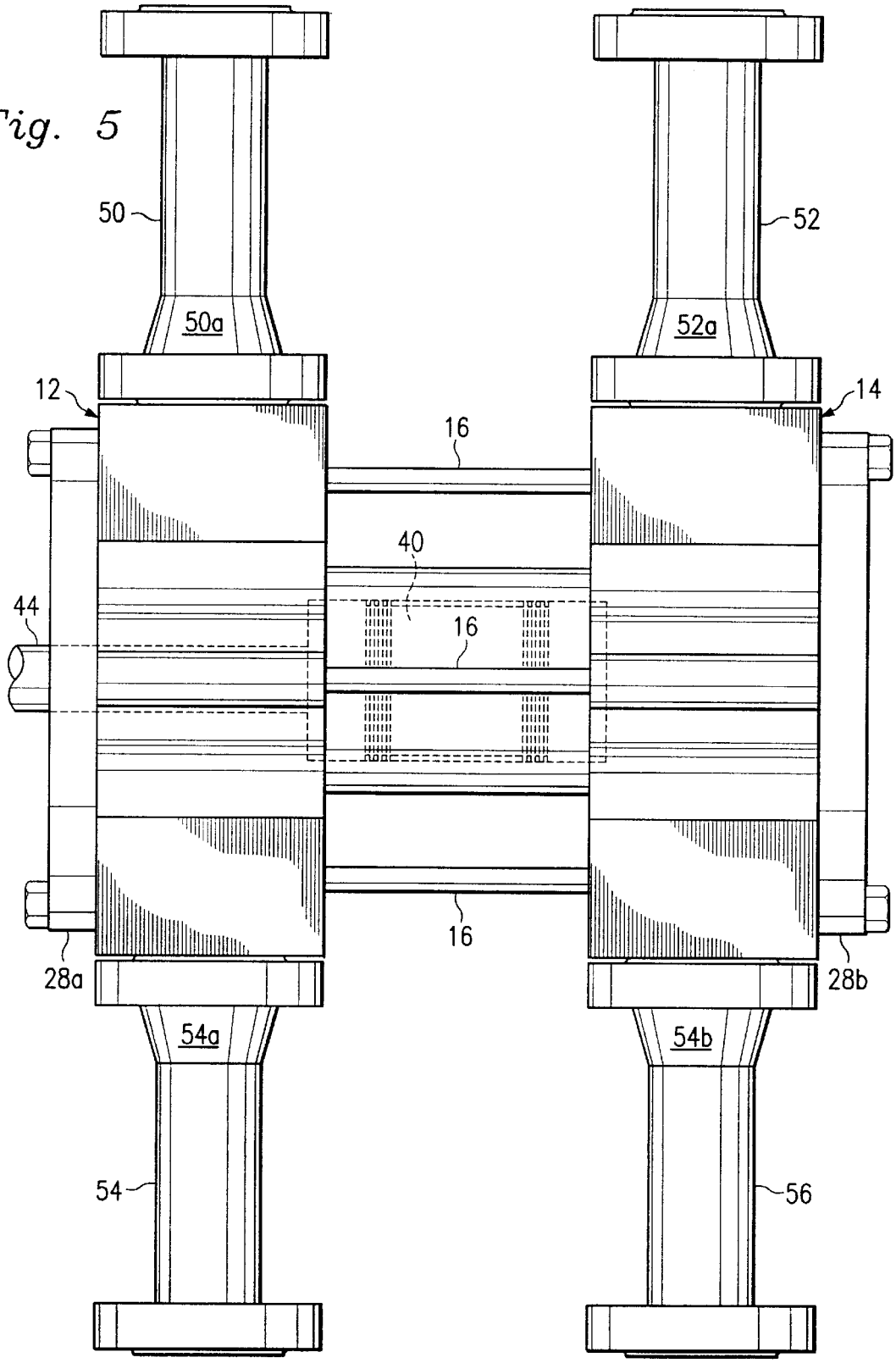
FIG. 5 is a view similar to that of FIG. 1, but depicting an alternate embodiment of the gas compressor assembly.

The embodiment of FIG. 5 is similar to that of FIGS. 1–4 with the exception that the manifold 20 has been replaced with two inlet ducts 50 and 52 having heads 50*a* and 52*a*, respectively bolted to the upper surfaces of the end heads 12 and 14, respectively, as viewed in FIG. 1. The ducts 50 and 52 register with two inlet openings formed in the upper surfaces of the heads, 12 and 14, respectively to introduce gas into the heads in the same manner as described in connection with the embodiment of FIGS. 1–4.

Similarly, the manifold 24 has been replaced with two outlet ducts 54 and 56 having heads 54*a* and 56*a*, respectively bolted to the lower surfaces of the end heads 12 and 14. The ducts 54 and 56 register with two outlet openings formed in the lower surfaces of the heads 12 and 14, respectively to pass the compressed gas to a receptacle or vessel, also in the same manner as described in connection with the embodiment of FIGS. 1–4.

Otherwise, the embodiment of FIG. 5 is identical to that of FIGS. 1–4 and the additional components are given the same reference numerals.

The embodiment of FIG. 5 permits a two-stage operation according to which gas to be compressed is introduced into the inlet duct 52 and passes though the header 14 and into the bore 34 for compression by the piston 40, in the manner discussed above. After it is compressed, the gas exits the header 14 via the outlet duct 56 and is reintroduced into the system 10 via the inlet duct 50 for further compression in the manner described above, before exiting via the outlet duct 54.

The embodiment of FIG. 5 enjoys all the advantages of that of FIGS. 1–4 with respect to the relatively easy and quick replacement of the cylinder 30. In addition, the ducts 50, 52, 54, and 56 do not have to be replaced to accommodate cylinders of different lengths, such as cylinders 30 and 30' but rather can be used in connection with cylinders of any length.

It is understood that references to "conduit", "duct, "cylinder", and the like are not meant to be limited to any particular fluid flow device and any such device or devices can be used throughout the system. Further, spatial references, such as "upper", "lower", "side", etc. are for the purpose of illustration only and do not limit the specific orientation or location of the structure described above.

Since other modifications, changes, and substitutions are intended in the foregoing disclosure, it is appropriate that the appended claims be construed broadly and in a manner consistent with the scope of the invention.

What is claimed is:

1. A method for compressing gas comprising the steps of connecting a compression cylinder between two heads, introducing gas into at least one header, passing the gas from the header into the cylinder, reciprocating a piston in the cylinder with a stroke corresponding to the length of the cylinder to compress the gas, discharging the compressed gas from the cylinder, disconnecting the cylinder from the heads, and connecting another cylinder between the heads, the other cylinder having a different bore length than the first-mentioned cylinder to permit a different stroke length of the piston.

2. The method of claim 1 further comprising the step of discharging the gas from the cylinder, through the one end header, and to a storage receptacle.

3. The method of claim 2 further comprising the steps of introducing gas into the other header, passing the gas from the other header into the cylinder for compression by the piston and discharging the gas from the other header.

4. The method of claim 3 wherein the gas is discharged from one end header while it is introduced into the other end header during movement of the piston in one direction.

5. The method of claim 4 wherein the gas is discharged from the other end header while it is being introduced into the one end header during movement of the piston in a direction opposite the one direction.

6. The method of claim 1 wherein the step of introducing comprises the step of passing the gas from a manifold into the end header, and wherein the step of discharging comprises the step of passing the gas from the end header to a manifold.

7. A method for compressing gas comprising the steps of connecting a compression cylinder between two heads, introducing gas into at least one header, passing the gas from the header into the cylinder, reciprocating a piston in the cylinder with a stroke corresponding to the length of the cylinder to compress the gas, discharging the compressed gas from the cylinder, disconnecting the cylinder from the heads, removing the cylinder from the two heads, and connecting another cylinder between the two heads, the other cylinder having a different bore than the first-mentioned cylinder.

8. The method of claim 7 wherein the first-mentioned cylinder has a damaged or worn out bore.

9. The method of claim 7 further comprising the step of discharging the gas from the cylinder, through the one end header, and to a storage receptacle.

10. The method of claim 7 further comprising the steps of introducing gas into the other header, passing the gas from the other header into the cylinder for compression by the piston and discharging the has from the other header.

11. The method of claim 10 wherein the gas is discharged from one end header while it is introduced into the other end header during movement of the piston in one direction.

12. The method of claim 11 wherein the gas is discharged from the other end header while it is being introduced into the one end header during movement of the piston in a direction opposite the one direction.

13. The method of claim 7 wherein the step of introducing comprises the step of passing the gas from a manifold into the end header, and wherein the step of discharging comprises the step of passing the gas from the end header to a manifold.

14. A method for compressing gas comprising the steps of connecting a compression cylinder to a head, introducing gas into the head, passing the gas from the head into the cylinder, reciprocating a piston in the cylinder with a stroke corresponding to the length of the cylinder to compress the gas, discharging the compressed gas from the cylinder, disconnecting the cylinder from the head, and connecting another cylinder to the head, the other cylinder having a different bore length that of the first-mentioned cylinder to permit a different stroke length of the piston.

15. The method of claim 14 wherein the compressed gas is discharged from the first-mentioned cylinder into the head, and further comprising discharging the gas from the head.

16. The method of claim 14 wherein the cylinder is connected at one end to the head and further comprising connecting the other end of the cylinder to another head.

17. The method of claim 16 further comprising the steps of introducing gas into the other head, passing the gas from the other head into the first-mentioned cylinder for compression by the piston, discharging the latter gas from the first-mentioned cylinder into the other head, and discharging the gas from the other head.

18. The method of claim 17 wherein the gas is discharged from one head while it is introduced into the other head during movement of the piston in one direction.

19. The method of claim 18 wherein the gas is discharged from the other head while it is being introduced into the one head during movement of the piston in a direction opposite the one direction.

20. The method of claim 14 wherein the step of introducing comprises the step of passing the gas from a manifold into the head, and wherein the step of discharging comprises the step of passing the gas from the head to a manifold.

21. A gas compression kit comprising at least one head, two compression cylinders adapted to be selectively detachably connected to the head, and a piston adapted for mounting in either of the cylinders for reciprocal movement, the cylinders having the same diameter and different lengths to permit different stroke lengths of the piston.

22. The kit of claim 21 further comprising means for introducing gas into the head for passage through the head and into the cylinder that is connected to the head for compression by the piston.

23. The kit of claim 22 wherein the gas is discharged from the latter cylinder into the head and is discharged from the head.

24. The kit of claim 23 wherein there is another head and wherein the cylinder is connected at its ends to the respective heads.

25. The kit of claim 24 further comprising means for introducing gas into the other head, and means for passing the gas from the other head into the latter cylinder for compression by the piston.

26. The kit of claim 25 further comprising means for discharging the gas from the latter cylinder into the other head, and means for discharging the gas from the other head.

27. The kit of claim 26 further comprising means for discharging the gas from the one head while it is introduced into the other head during movement of the piston in one direction.

28. The kit of claim 27 further comprising means for discharging the gas from the other head while it is being introduced into the one head during movement of the piston in a direction opposite the one direction.

29. The kit of claim 28 further comprising a first manifold connected to the heads for introducing the gas into the heads, and a second manifold connected to the heads for receiving the gas from the heads.

* * * * *

UNITED STATES PATENT AND TRADEMARK OFFICE

CERTIFICATE OF CORRECTION

PATENT NO. : 6,318,967 B1
DATED : November 20, 2001
INVENTOR(S) : William C. Wirz and Robert A. Bennitt It is certified that error appears in the above-identified patent and that said Letters Patent is hereby corrected as shown below:

Column 5, claim 14,
Line 23, change "that" to -- than --.

Signed and Sealed this

Second Day of April, 2002

*Attest:*

*Attesting Officer*

JAMES E. ROGAN
*Director of the United States Patent and Trademark Office*